US009083125B2

(12) United States Patent
Rogers

(10) Patent No.: US 9,083,125 B2
(45) Date of Patent: Jul. 14, 2015

(54) ADAPTOR

(71) Applicant: DG International Holdings Limited, London (GB)

(72) Inventor: Jack Rogers, London (GB)

(73) Assignee: DG International Holdings Limited, London (GB)

( * ) Notice: Subject to any disclaimer, the term of this patent is extended or adjusted under 35 U.S.C. 154(b) by 0 days.

(21) Appl. No.: 14/213,165

(22) Filed: Mar. 14, 2014

(65) Prior Publication Data

US 2014/0199867 A1 Jul. 17, 2014

Related U.S. Application Data

(63) Continuation of application No. PCT/GB2012/052283, filed on Sep. 14, 2012.

(30) Foreign Application Priority Data

Sep. 16, 2011 (GB) ..... 1116148.6

(51) Int. Cl.
*H01R 27/00* (2006.01)
*H01R 31/06* (2006.01)
*H01R 24/68* (2011.01)

(52) U.S. Cl.
CPC ..... *H01R 27/00* (2013.01); *H01R 31/06* (2013.01); *H01R 24/68* (2013.01)

(58) Field of Classification Search
CPC ..... H01R 27/00; H01R 31/06; H01R 2103/00
See application file for complete search history.

(56) References Cited

U.S. PATENT DOCUMENTS

| | | | | |
|---|---|---|---|---|
| 4,013,330 | A | 3/1977 | Hugly | |
| 4,626,052 | A * | 12/1986 | Rumble | 439/173 |
| 4,997,381 | A | 3/1991 | Oh | |
| 5,613,863 | A * | 3/1997 | Klaus et al. | 439/131 |
| 5,851,123 | A * | 12/1998 | Chou | 439/172 |
| 6,062,884 | A | 5/2000 | Messimer et al. | |
| 6,382,996 | B1 | 5/2002 | Eyman | |
| 7,220,139 | B1 * | 5/2007 | Chang et al. | 439/172 |
| 7,950,938 | B1 * | 5/2011 | Teoh | 439/171 |

(Continued)

FOREIGN PATENT DOCUMENTS

| | | | |
|---|---|---|---|
| CN | 1848548 | A | 10/2006 |
| CN | 2914350 | Y | 6/2007 |

(Continued)

*Primary Examiner* — Gary Paumen
(74) *Attorney, Agent, or Firm* — Dickstein Shapiro LLP

(57) ABSTRACT

An adaptor for adapting a mains plug according to a first national standard to a mains socket according to a second, different second national standard. The adaptor comprises a housing with a socket for receiving the first mains plug, and at least two plug assemblies according to different national standards, one of the at least two plug assemblies being according to the second national standard. An externally-operable selection mechanism is provided for selectively deploying, or at least for making externally deployable, one of the at least two plug assemblies while simultaneously concealing, at least partially, the remaining plug assembly or assemblies so to make them effectively unusable. The end user can thus effortlessly select one of the outputs while hiding one that is not necessary. A network of internal conductors for providing electrical continuity between the first mains plug and the selected plug assembly is provided inside the adaptor.

20 Claims, 7 Drawing Sheets

(56) References Cited

U.S. PATENT DOCUMENTS

| | | | | |
|---|---|---|---|---|
| 8,157,578 | B2 * | 4/2012 | Lee | 439/223 |
| 8,734,168 | B2 * | 5/2014 | Lee et al. | 439/95 |
| 2002/0173187 | A1 * | 11/2002 | Schmitt | 439/171 |
| 2003/0228778 | A1 * | 12/2003 | Shang | 439/172 |
| 2004/0097114 | A1 * | 5/2004 | Shiroshita et al. | 439/174 |
| 2005/0153588 | A1 | 7/2005 | Liao | |
| 2006/0110963 | A1 * | 5/2006 | Cheng | 439/171 |
| 2006/0148291 | A1 * | 7/2006 | Bona et al. | 439/172 |
| 2009/0081895 | A1 * | 3/2009 | Lee et al. | 439/173 |
| 2009/0186503 | A1 * | 7/2009 | Dobler | 439/172 |
| 2011/0097915 | A1 * | 4/2011 | Ruffner | 439/174 |
| 2012/0100733 | A1 * | 4/2012 | Lee et al. | 439/172 |

FOREIGN PATENT DOCUMENTS

| | | | |
|---|---|---|---|
| CN | 201044313 | Y | 4/2008 |
| CN | 101394051 | A | 3/2009 |
| DE | 199 02 642 | A1 | 7/2000 |
| EP | 1 393 417 | A | 3/2004 |
| WO | WO 02/063723 | A2 | 8/2002 |
| WO | WO 2006/114035 | A1 | 11/2006 |
| WO | WO 2009/152629 | A1 | 12/2009 |
| WO | WO 2009/152632 | A1 | 12/2009 |

* cited by examiner

ADAPTOR

The present invention concerns an adaptor. In particular, the present invention relates to an adaptor of the kind that is generally used for adapting plugs (for mains electricity) when travelling abroad, i.e. to countries which adopt electricity plugs and sockets having different pin/hole shapes and/or configurations, or when using non standard electrical plugs, or power plugs, at home.

Power plugs, or mains electricity plugs, or mains plugs, as they are often called, connect mechanically to suitable power sockets. Plugs and their sockets differ widely, usually from country to country, in shape, size and type of connection (earthed/unearthed, polarized/not polarized, fused/not fused, 2 pin, 3 pin or 4 pin (e.g. three phase), etc. . . . ). As a result, numerous mains plug travel adaptors have been manufactured and sold in the market. These range from simple, single format adaptors with a fixed input format and a fixed output format (e.g. UK female to US male), to more versatile multiple format adaptors. The latter forms can have a fixed output format and variable input formats, or a fixed input format and variable output formats. for example, a typical multiple format adaptor may have a UK female input and an adaptable output that can be configured either as a US male output or a European male output, or it could be a more universal input format (with pin holes for receiving any of UK, European or US inputs), and a fixed output, e.g. a South African or Australian output.

More sophisticated adaptors have also been developed. For example, nearly universal "sliding" adaptors have been created, with multiple output formats, each being selectively extendable and retractable. See for example EP 1393417 B1, which discloses a travel plug comprising a socket on one side and, on the opposite side, several pin contacts of various types that can be selectively extended and retracted.

"Single" adaptors are light, reliable and generally inexpensive, but they lack versatility, for example, for multi-destination trips. "Multiple" adaptors are also generally reliable. They also offer a greater degree of versatility. However, depending on how many outputs they provide, they tend to be more expensive and bulky. Further they can be aesthetically unsightly, especially forms with multiple outputs of a fixed pin format, i.e. spider adaptors. "Sliding" adaptors can look more compact, especially than those "spider" adaptors, and they can be extremely versatile. However, they are usually mechanically more complex, and therefore more expensive to manufacture. They can also be more prone to failure through misuse.

It would be desirable to provide an alternative type of travel adaptor that is one or more of the following: simple; reliable; compact; inexpensive to manufacture; user friendly; aesthetically pleasing. Preferably it will be more so than the travel adaptors of the prior art.

According to a first aspect of the present invention there is provided an adaptor for adapting a mains plug according to a first national standard to fit into a mains socket according to a second, different, national standard, the adaptor comprising:

a housing with a socket for receiving a mains plug according to the first national standard;

at least two plug assemblies according to different national standards, each having a deployable part in accordance with at least one pin component of the respective national standard, one of the at least two plug assemblies being according to the second national standard;

an externally operable selection mechanism for selectively deploying, or for making externally deployable, a non-deployed deployable part of one of the at least two plug assemblies, the non-deployed deployable part, upon its deployment, becoming insertable into a mains socket in accordance with the respective national standard therefor and thereby making the said one of the at least two plug assemblies usable, and the selection mechanism also, simultaneously, at least partially concealing a deployed deployable part of a different one of the at least two plug assemblies to render that previously usable, different one of the at least two plug assemblies, now unusable; and a network of internal conductors for providing at least two respectively insulated paths of electrical continuity between the socket of the housing and a usable one of the at least two plug assemblies.

Adaptors according to the invention are simple to use by virtue of their "dual effect" action—deployment of the necessary plug and simultaneous concealment of the unnecessary plugs. The dual effect action also provides a conceptual basis for providing a streamlined design of adaptor, with less mechanical parts, potentially smaller barrel/body designs, and cheaper production costs.

In one embodiment, at least one of the plug assemblies can be arranged to be in a fixed arrangement with respect to the housing during the operation of the selection mechanism, the fixed position of such a plug assembly being the position of that plug assembly, relative to the housing, when that assembly is in an operational condition, i.e. when it is useable. The externally-operable selection mechanism then preferably comprises a displaceable cover that is displaceably arranged with respect to both the housing and that fixed plug assembly. Preferably when the selection mechanism is operated, the displaceable cover is spatially displaced relative to the housing so as conveniently to provide a concealing action over the fixed plug assembly.

Preferably there is only a single fixed plug assembly, and that fixed plug assembly is permanently fixed in that fixed arrangement with respect to the housing.

In a particularly compact embodiment, the displaceable cover is an inner core of the housing. That core could then be displaceable out of the housing.

If the displaceable cover is made into a slidingly displaceable cover with respect to the housing, then operation of the adaptor is particularly simple—in one embodiment it can simply be slid out to conceal the fixed plug assembly, with the newly deployed deployable part of another plug assembly then becoming the operational plug assembly.

In a preferred embodiment, the displaceable cover is telescopically displaceable with respect to the housing. It could be a single telescopic piece, or it may take the form of multiple telescopic pieces, the latter potentially allowing further compactness for the housing and cover.

In some embodiments, at least one plug assembly is mounted on or within the displaceable cover such that it has a selectively moveable arrangement with respect thereto. The displaceable cover has an output face and said plug assembly has at least two pin contacts, the pin contacts of that plug assembly being extractable so as to extend from the output face of the displaceable cover. The pin contacts may be arranged to extract in unison, or they may be separately extractable. The pin contacts provide the deployable part of the plug assembly.

If it is desired to hide one or both of the pin contacts, the output face may be provided with a cover plate, and the cover plate may be moveable with respect to the output face to selectively reveal or hide the contact pins. The cover plate may be rotatable parallel to the plane of the output face, e.g. to slide over the surface of the output face, potentially in a recessed portion thereof. Alternatively it might be hinged relative thereto, or it might be linearly slideable relative thereto.

It can be geometrically convenient to make the displaceable cover and the housing coaxial. It may also be convenient or additionally convenient to make the displaceable cover and the housing substantially axial-symmetric.

For ease of use by a user, the displaceable cover may be retainable into a position by a click fit or snap fit provided in cooperation with the housing.

The housing and the displaceable cover may be substantially cylindrical, with opposing end caps, with the two components fitting snugly together one inside the other, with end caps facing outwards.

Preferably the cover can be housed substantially within the housing prior to deployment thereof into an extended position—i.e. a position in which it is moved to cover a fixed deployable part of a plug assembly.

The externally-operable selection mechanism may comprise a sliding lever. It may protrude outwardly of the displaceable cover, and it will preferably be readily accessible by a finger or thumb of a user, which makes for easy operation.

Preferably the selection mechanism has a safety lock mechanism to avoid or reduce the likelihood of an inadvertent switch from one standard to another. The safety lock mechanism may include a spring mechanism. It may require an initial depression of a sliding lever prior to sliding, e.g. to move a part of the lever past a shoulder of the housing.

Conveniently, the adaptor also has a third respectively insulated path of electrical continuity between the socket of the housing and a usable one of the at least two plug assemblies, or to an earth therefor. The adaptor can then be for a three pin mains plug.

If it is for a four pin plug, such as a three phase plug, then a fourth insulated path of electrical continuity would be provided.

Preferably the displaceable cover comprises a separate earth connection.

It is preferred that one of the national standards is the Schuko (or Shuko) configuration.

It is preferred that one of the national standards is the United Kingdom or British national standard.

It is preferred that one of the national standards is the Europlug national standard.

It is preferred that one of the national standards is the US national standard.

It is preferred that one of the national standards is the Australian national standard.

The deployable part for the US national standard might be formed with two relatively rotatable pins that allow a switch from the US national standard to the Australian national standard.

It is preferred that one of the national standards is the Japanese national standard.

The adaptor may have a displaceable cover that has an outer profile compatible with the Schuko (or Shuko) configuration.

The adaptor may have a displaceable cover that has an outer profile compatible with the Europlug configuration.

Preferred adaptor constructions include a US input and UK and European outputs, an Australian input and UK and European outputs, an Australian input and US and UK outputs, an Australian input and US and European outputs, a South African input and UK and European outputs, a South African input and UK and US outputs, a South African input and US and European outputs, a European input and UK and US outputs. Other combinations are also desirable as would be clear to a skilled person, including Japanese, Shuko and adaptable forms (e.g. the rotatable US pins, or inputs that can receive multiple formats).

The adaptor may further comprise a biasing means for assisting with relative deployments, such as the movement of a deployable part of a plug assembly relative to a displaceable cover. For example, the former can be preloaded under a biasing force when stowed in a non-use position, and can be released to shoot out into a relatively deployed position upon a single touch of a release mechanism. Preferably that release mechanism is the externally operable selection mechanism.

An optional provision of locking means for locking moveable plugs in their respective deployed configurations can be used to ensure proper electrical connectability. For example, they can have a thread that screws into a corresponding thread of an electrical contact that forms part of the respective network of internal conductors during their respective deployment process.

To switch the adaptor from one adaptor configuration, with a first one of the plug assemblies being deployed, into another adaptor configuration, with a second one of the plug assemblies instead being deployed, it is preferred that the externally operable selection mechanism is slid linearly from one end of the housing towards the other end of the housing. A pushing of that externally operable selection mechanism therefore causes that operation of the adaptor. The externally operable selection mechanism therefore preferably takes the form of a sliding lever. The lever preferably has a tactile feedback—clicking into the deployed, or retracted, position. The tactile feedback may be provided by a locking mechanism. Depressing the lever radially relative to the housing may be the preferred means for releasing such a locking mechanism.

In some embodiments, the selection mechanism may comprise a mechanical switching means, or toggle, for switching the adaptor between alternative output configurations.

The switching means may comprise a guiding plate or toggle which is operably connected or connectable to the alternative plug assemblies. The guiding plate can be operably interposed between two of the alternative plug assemblies.

Preferably two separate plug assemblies define two separate planes.

Preferably the guiding plate defines a plane that is substantially parallel to a plane that is defined by at least one of the plug assemblies. More preferably the guiding plate is substantially parallel to the planes defined by the two separate plug assemblies, there being only those two plug assemblies.

Preferably at least one of the plug assemblies is arranged to slide between its deployed position and its non-deployed position by sliding at least the deployable part thereof along the plane defined by that plug assembly.

The guiding plate may be rotatable around a fixed pivot provided in the housing to provide a switching action, and the guiding plate may further comprise at least one side extending arm for engagement with one of the plug assemblies. Preferably it has two arms, each one for engagement with one of two plug assemblies.

The guiding plate may comprise at least a pair of recesses each corresponding to one of the side arms, which are additionally useful to engage the or each plug assembly.

Advantageously, operation of the selection mechanism may cause the guiding plate to rotate either one way or the other way, about its pivot, depending on which plug assembly is to be deployed.

Two alternative plug assemblies may be connected (or connectable) to the guiding plate, on opposite sides thereof, so that the switching mechanism is well balanced during operation. This gives a smooth and consistent feel during respective switching operations.

Conveniently, operation of the selection mechanism may be performed via an actuation lever or button provided externally of the housing.

In a further aspect of the present invention, there is provided a mains cable for plugging an electrical appliance selectively to at least two different sockets according to two different standards, wherein selection of the output plug is in accordance with the present invention.

According to another aspect of the present invention, there is provided a telescopic travel adaptor for adapting a mains plug according to a first national standard to fit into a mains socket according to a second, different, national standard, the adaptor comprising:

a first base;

a second base that is telescopically extendable relative to the first base; and at least two plug assemblies according to different national standards, one of the at least two plug assemblies being according to the second national standard; wherein the mains plug according to the first national standard can be plugged into the first base; and one of the plug assemblies is configured for selectively extending out of the second base into a usable configuration for plugging into the mains socket according to the second, different, national standard when the second base has been telescopically extended; and another of the plug assemblies is configured in the adaptor for being at least partially concealed, and therefore caused to be unusable with respect to its respective national mains socket standard, by that telescopic extension.

This second aspect of the invention may feature any or all of the features of the first aspect of the invention that are set out above, either with or without the essential features set out in claim 1.

In a further aspect of the present invention, there is provided a mains cable for plugging an electrical appliance selectively to at least two different sockets according to two different standards, the mains cable having a mains plug on its end, the mains plug featuring an adaptor mechanism with at least two plug assemblies therein, wherein the operation of the respective plug assemblies, and the selection or mode of deployment of a respective one thereof, is in accordance with the arrangement provided with respect to any of the above aspects of the adaptor of the present invention. This cable, however, need not have the socket in the housing for receiving a mains plug according to the first national standard. Instead the second of the at least two plug assemblies is in accordance with that first national standard.

The present invention also provides a method of operating an adaptor as set out above, such as by using the methods disclosed below.

BRIEF DESCRIPTION OF THE DRAWINGS

These and other features of the present invention will now be described, purely by way of example, with reference to the accompanying drawings in which.

DETAILED DESCRIPTION OF THE PREFERRED EMBODIMENTS

Figure 1:
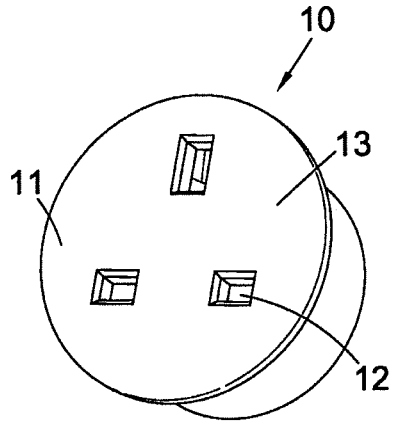
FIG. 1 is a first perspective view of an adaptor according to a first embodiment of the present invention, showing the front face, with a mains plug socket of a first national standard thereon—the UK or British standard.

With reference to FIG. 1, there is shown a first travel adaptor 10. This adaptor 10 allows a user to adapt a UK mains plug to fit into, i.e. to connect to, both American and European mains sockets. It will readily be appreciated, however, that this is only one form of adaptor, and that the "input" and "output" standards can vary from the ones shown in the present embodiment, depending on the market for which the product is being sold. For example, the input might be a US input, and the outputs might be UK and European.

Returning to the present embodiment, however, adaptor has an input face 13 that has a three-pin UK-type socket (female) 12 for receiving a mains plug (not shown) according to the UK standard. The pins of that plug are illustrated in FIG. 20, and we will refer again to that Figure later on.

Figure 14:
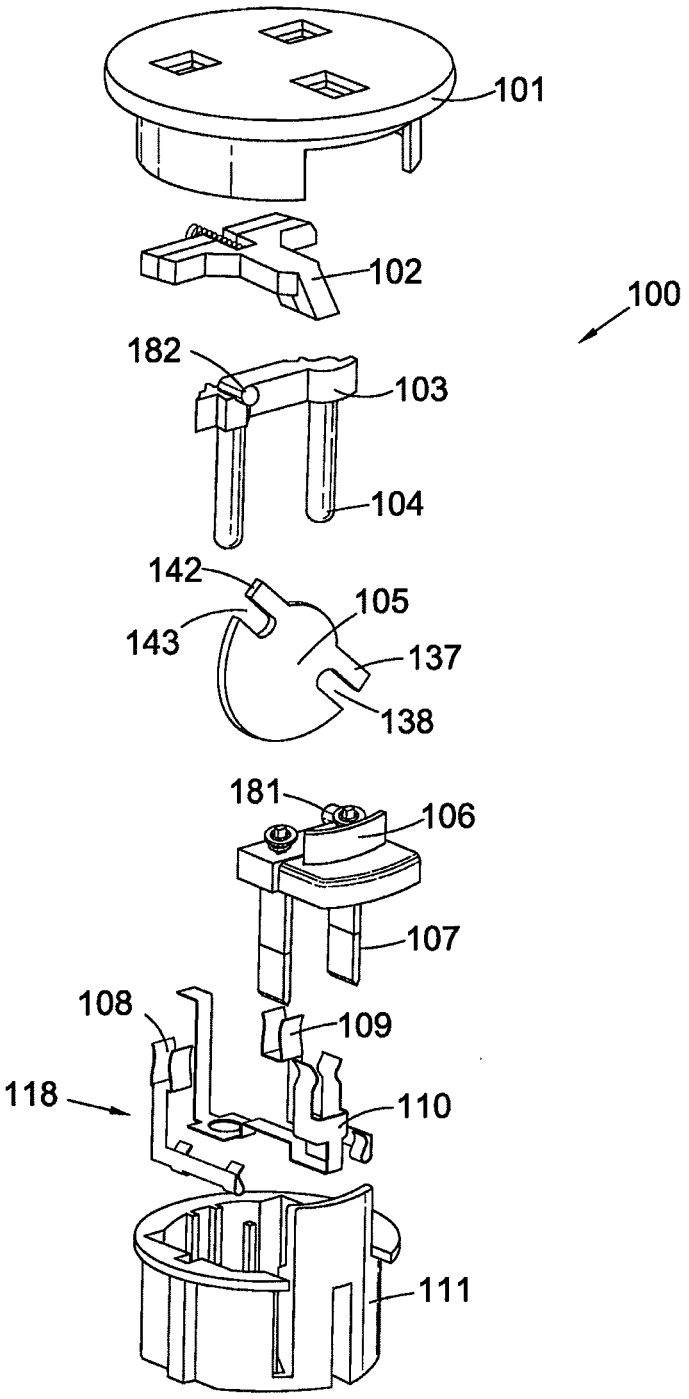
FIG. 14 is an exploded view of a travel adaptor according to a third embodiment of the invention, showing a possible configuration for a network of internal conductors of the adaptor, and a toggle mechanism that is operable by the operating lever.

As is customary with travel adaptors for receiving UK mains plugs, and some other forms too, the socket 12 is coupled with a sprung security shutter. This shutter 102 is best seen in the embodiment of FIG. 14. The shutter is arranged such that it is lifted or displaced from the openings of the socket only when a user inserts an appropriate plug—with an extended earth pin. That first pin then causes all three openings of the socket to open, thus allowing the plug to be inserted into the socket.

The input face 13 is part of a housing 11 of the adaptor. The housing is generally made of an insulating plastics material. This housing is the component that will generally remain visible from the outside during all uses of the adaptor, and thus it is the part that gets gripped during use. It is also configured for housing the internal components of the travel adaptor 10, so it is hollow.

Figure 2:
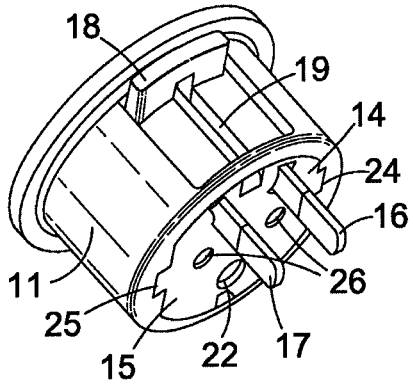
FIG. 2 is a second perspective view of the adaptor of FIG. 1 showing a rear or output face thereof with two pins of an American, or US, national mains plug standard.

FIG. 2 shows details of the plug side (i.e. the male side) of the travel adaptor 10. There is shown a deployed American plug or plug assembly 16 comprising two flat pins 17 protruding out of the output face 14 of the adaptor 10. The pins are insulated at their base to prevent accidental electrocution during insertion of the adaptor into a wall socket, and they can be swiveled to convert to, for example, Australian formats.

in FIG. 2, the adaptor is ready to be plugged into a US national standard wall socket, i.e. its two pins are fully deployed so that a user can insert the adaptor into a compatible, e.g. American, mains socket to establish electrical continuity between the wall socket and socket of the adaptor 10.

The adaptor's housing 11 accommodates an internal or inner core 15, which is slideably coupled to the housing 11. The inner core 15 is an externally chunky-looking component which has the general outer shape of a drum, or such like. The shape illustrated is in accordance with the European or German shuko standard. The inside of the housing is appropriately profiled to accommodate that shape.

Inside that core, the internal components of the travel adaptor 10 are accommodated, in conjunction with the outer housing 11. The pins for the American plug 16, however, are external of that core in FIG. 2—they extend through the bottom end, or cap, of the core in a fixed condition relative to the housing 11.

Since the user can slide the inner core 15 out of the housing 11 by means of an external lever or button 18, which is mounted on the inner core, that core can be slid over the pins of the American plug. Operation of the lever or button 18 thus allows the user to selectively extract or retract the inner core as required in a telescopic manner, revealing or concealing those pins respectively.

Figure 3:
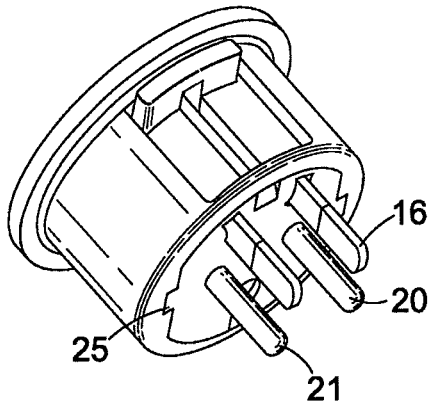
FIG. 3 is a further perspective view of the adaptor of FIGS. 1 and 2, in a part switched state, whereby it now additionally shows two pins of the European standard—either Europlug or Shuko—in a part deployed configuration. Those pins were spring loaded for shooting out upon starting to depress and/or slide an operating lever, e.g.—a radial depression of the lever prior to sliding it.

Prior to sliding, in this embodiment the lever must first be radially depressed—compare FIGS. 2 and 3. That depression shifts a part of the lever off a catch, thereby allowing it to slide.

Along a side of the inner core 15, a longitudinally extending slot is formed. This is to allow a third pin (earth connection) of the UK mains plug to be inserted through the input face 13 of the adaptor's housing 11 into the adaptor 10. A slot is also formed on the lower side of the lever or button 18, also to provide space for that earth connection.

A few additional features are also visible in FIG. 2 on the output face 14 of the adaptor 10. The linear, non-rotating, telescopic sliding mechanism between the housing and the core, for example, is obtained by means of two opposed grooves or slots 25 formed on the inner wall of the adaptor's housing 11. These are designed to be coupled to corresponding, opposed, protrusions 24 formed on the outer wall 23 of the inner core 15.

The inner core 15 will be made of a non-conducting plastics material.

Holes 26 formed through the inner core 15 are also provided to allow the European pins 21 to be deployed when necessary (see description of FIG. 3 below).

A European female earth connection 22 is also provided in the inner core 15.

When a user pushes down the sliding lever or button 18, this releases the European pins 21, which shoot forwards by means of an internal spring bias they can be spring-loaded. FIG. 3, therefore, shows the result of starting to depress the operating button 18. The result is two sets of pins, American 17 and European 21, now being simultaneously in their deployed or extended condition relative to the output face 14 of the adaptor's core.

While the American pins and plug assembly 17, 16 are fixed relative to the housing 11, the European pins 21 and plug assembly 20, in this embodiment, are mounted for movement on or with the inner core 15. Therefore they will move therewith when the inner core 15 is extracted or extended from the housing 11. The European pins 21 can therefore both initially move relative to the inner core 15, for becoming initially exposed from the inner core, upon starting to depress the operating button, and thereafter they can move together with the inner core 15 as that core is moved or translated forwards and backwards relative to the housing 11. They could be fixed relative to the core by the spring bias, or they could be secured into that fixed position by twisting them about their axes, e.g. to engage screwthreads on the bases of the pins onto screwthreads on the holes 26 of the core As the inner core is slid forward, or drawn forward, telescopically in this embodiment, the American pins 17 get gradually hidden by the inner core 15. This is shown in an intermediate phase in FIG. 4.

Once extended, a locking means such as the above mentioned twisting of the pins can be used to lock the pins in place on the inner core 15. This can be done before or after starting to move the core relative to the housing. This locking means is only provided to lock the European pins in place relative to the core. It does not interact with the American pins 17.

Figure 4:
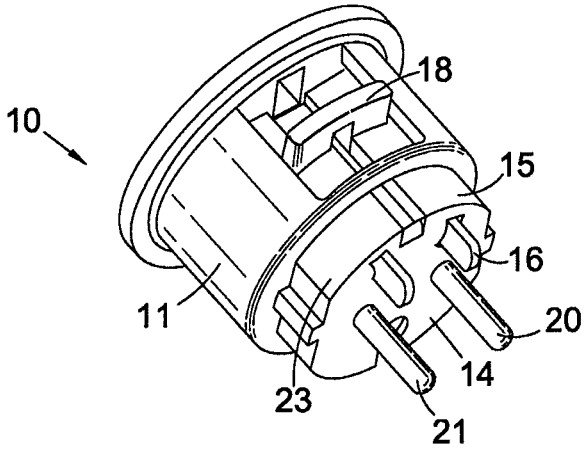
FIG. 4 is a further perspective view of the adaptor of FIGS. 1, 2 and 3, but with the switching process further progressed.

Because the American pins 17 are fixed relative to the housing, they become hidden or are "retracted" relative to the inner core 15 as the inner core 15 is pushed out of its housing 11. In FIG. 4, only the conductive part of the American pins remains externally visible, while the insulated portions of the pins 17 are already housed in an internal space of the adaptor 10.

Figure 5:
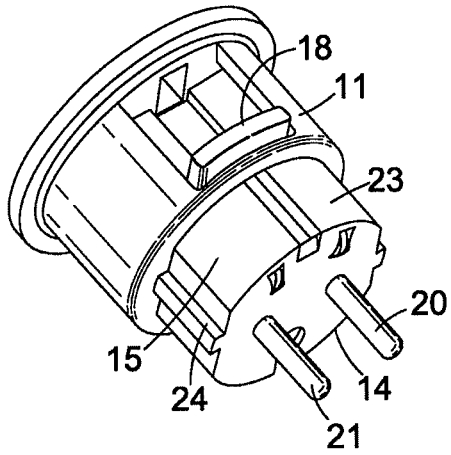
FIG. 5 is a further perspective view of the adaptor of FIGS. 1 to 4 in the fully switched state, now showing just the two pins of the European standard.
Figure 6:
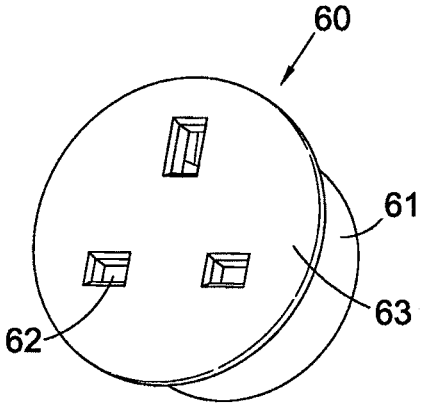
FIG. 6 is a first perspective view of an alternative adaptor, i.e. according to a second embodiment of the present invention.

FIG. 5 shows the adaptor 10 ready for use in the European mode, i.e. ready to adapt a UK mains plug to a European mains socket. Naturally, in order to make this possible, the input and output electrical components (Le. respectively, the UK mains plug and the European pins 21) of the adaptor need to be electrically connected, as it will be readily apparent to the person skilled in the art.

In FIG. 5, the European pins 21 are fully deployed. Further, core is clicked out into its fully extended position. A click-lock may temporarily secure or indicate that full extension. Yet further, the outer shape 23 of the inner core takes the shape of a Schuko or Shuko plug. This form allows the adaptor to correctly fit into a wall socket.

The core is also designed provide an earth connection for the adaptor. In France, the earth connection is provided by an earth pin present within the wall socket. That earth pin fits into a hole or socket 22 formed in the core 15. See, for example, FIG. 2.

The socket 22 leads to a conductor element within the adaptor, which can electrically connect to the earth pin. That conductor element can then provide an electrical connection to the third pin of a UK plug within the socket on the front face of the adaptor via the network of conductor elements within the adaptor, such as that shown in FIG. 20.

To return the adaptor to the American configuration, reverse operations cab be carried out. The European pins might be retracted first, e.g. by undoing their locking mechanism. Then the user can pressing back the pins against their corresponding spring mechanism to click into a locked, retracted condition. Then, the inner core 15 can be pushed back into the housing until it resides back within the housing. In this position, the output face 14 becomes again flush with the distal end of the adaptor's housing 11, as shown in FIG. 2. This movement of the core can be done by pushing the core, or by pushing the operating lever 18.

This movement of the core should be easy to achieve, as the inner drum 15 was only retained by the distal end either by an interference fit, or by the above-mentioned click-lock.

The click-lock could take any one of many forms known to skilled persons in the art of telescopic members, and will generally involve formations in both the outer wall 23 of the inner core 15 and the inner wall of the housing 11.

When the core has been fully retracted back into the housing, telescopically, it likewise can click back in place due to a second click lock.

In this condition, therefore, the US pins are once again exposed, and ready for use.

Next, with reference to FIGS. 6 to 13, there is now illustrated a second embodiment of adaptor 60. Again, this is designed to adapt a UK type plug to overseas type sockets, in this case once again the American type sockets and European sockets. The adaptor is also again compatible with Australian sockets due to the rotatability of the US pins 66, 67. Different combinations of national standards, however, are equally useable with this form of adaptor, as already discussed in relation to the first embodiment.

Figure 7:
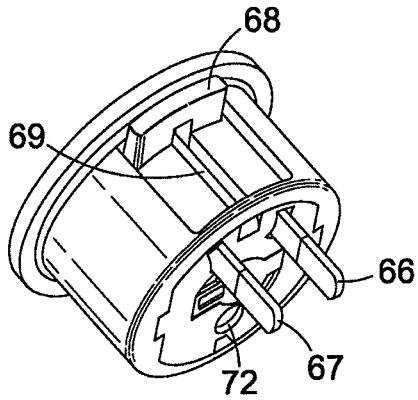
FIGS. 7 through 13 are further perspective views of the adaptor of FIG. 6 showing the process of switching the adaptor from an American or US configuration—FIG. 7—to a European Shuko configuration—FIG. 13. This, like the previous embodiment, involves the pressing and/or sliding of an operating lever, which causes a hiding or concealment of the US pins. However, the European pins in this embodiment must be extended manually, rather than being spring loaded for firing out in response to the depressing of the operating lever. For achieving that, a cover therefor is rotated to reveal the European pins (FIG. 11) and the pins are then extracted by turning the adaptor downwards before then rotating them to screw or lock them into their extended condition. The lever is nevertheless depressed radially prior to sliding to release a slide-lock mechanism.

FIG. 7 then shows a starting configuration for the adaptor in which the adaptor is configured for American electricity sockets, with the inner core 65 retained within the housing 61. However, the core can be telescopically deployed out of the housing 61 to hide the American pins 66, 67 again by operating the operating lever or button 68. This part of the operation is essentially very similar to the first embodiment. However, the European pins are not spring loaded, so they do not fire forwards upon a commencement of that telescoping procedure.

An earth connection 72 is still present on the bottom face of the adaptor, as a female socket on the output face 64 of the adaptor 60. This again allows earthed appliances to be correctly connected to the mains power's earth via the adaptor 60. Likewise, for the Shuko form of plug, the UK earth can provide that earth connection either directly or via other conductors on the edge of the core's wall (or in a slot therein). This would be useful, for example, for German applications.

As before, a slot 69 on the inner core ensures the insertability of the UK earth pin. Further, for the same reason, the lower side of the button 68 is also slotted.

Figure 8:
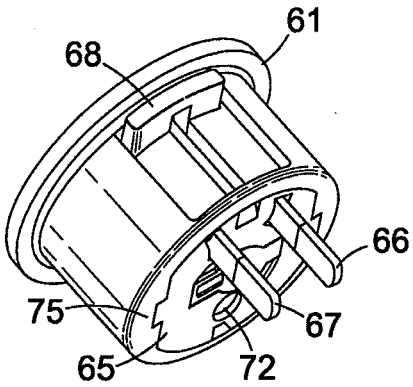

For converting the adaptor to its other configuration—the European configuration, again a user pushes down the lever 68 (FIG. 8). Again that can cause the core 65 to disengage from any core retaining means, such as a click-lock, that might be provided between the housing 61 of the adaptor 60 and the inner core 65. Thereafter, though, the lever 68 can be slid forwards to cause the inner core 65 to slide forwards and out of the open end of the housing 61.

Figure 9:
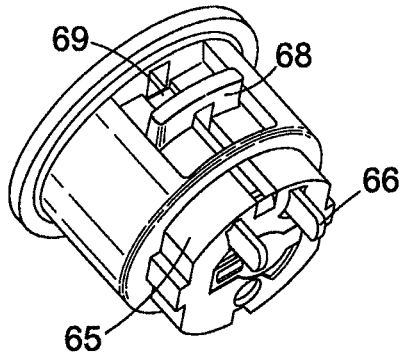
Figure 10:
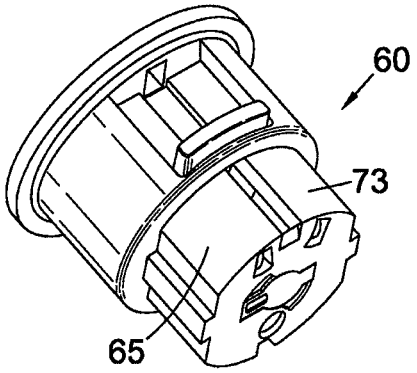
Figure 11:
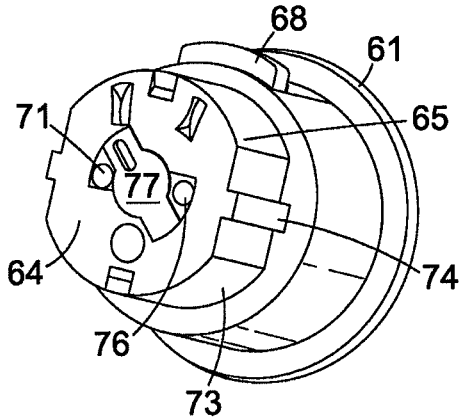
Figure 12:
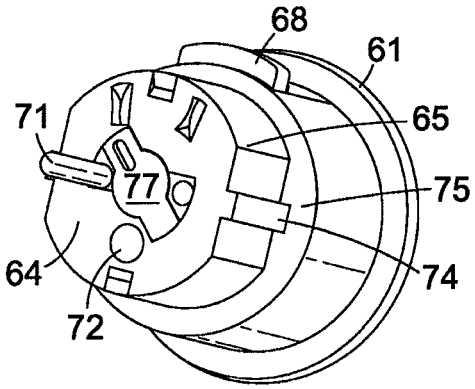
Figure 13:
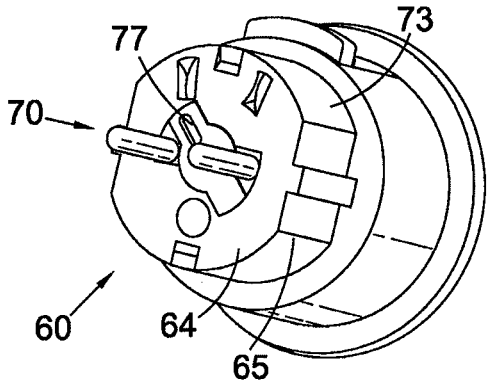

While the drum 65 slides forwards, the American pins 66, 67 become covered or concealed and, eventually, they become fully housed and hidden within the inner core 65. This gradual process is shown in FIGS. 9 and 10.

As before, to control the rotation of the core relative to the housing, again the outer wall 73 of the inner core 65 presents protrusions 74 which run in grooves, recesses or slots 75.

Once fully extended, and potentially again click-locked into that extended condition, the user would look to expose the European pins. For doing that a cover plate 77 first needs to be operated. That cover plate 77 is initially disposed so that it covers the free ends of the two European pins 71. Those pins, therefore, are not inititally visible from the output face 64 of the adaptor 61 when the American swivel pins 67 are deployed for use—see FIGS. 7 to 10. However, in FIG. 11, the cover has been rotated to reveal the European pins. In this embodiment the cover plate 77 is rotated through about 45 degrees to reveal the ends of the European connectors 71. Those pins can then be extracted by pointing the holes downwards, and grabbing the free ends of the pins 71.

It would be possible, in theory, to extend the pins before extending the core, but better practice would be to extend the core first—easier access to the cover plate is then provided.

The pins can thus be fully extended and locked in place by rotating them, e.g. to cause a screwthread on the pins, or a bayonet feature, to engage in a corresponding feature of the holes for the pins.

The European plug 70 is therefore formed or obtained in a slightly different manner compared to the previously described embodiment, i.e. without having them spring biased and released by the lever 68.

Reverting back to the US configuration is then just the reverse of those steps.

FIG. 14 illustrates a third embodiment of travel adaptor 100 in exploded view. The parts comprised in the assembly are: a cover plate or housing top 101, which, as with the housing of the previous embodiments, provides the input face for the to-be-adapted mains plug, in this case with a UK socket provided thereon; a spring loaded shutter 102 which opens the UK socket of the adaptor 100 only when suitable pressure is applied thereover primarily by the earth pin, i.e. the longer pin for UK plugs; a European plug assembly 103 for insertion into compatible European sockets; a guide plate or toggle 105 which works as a switching means for switching the adaptor between alternative configurations; a US (and if rotatable a Australian) plug assembly 106; an internal network of connections 118 comprising live 108, neutral 109 and ground/earth 110 connections; and a housing bottom cover 111 (corresponding to the core in the other embodiments).

The housing top 101 is snapped or press fitted or fixed with screws or the like to the housing bottom 111. The housing top and bottom parts 101, 111 thus define an internal space in which the remaining components can be arranged. In this embodiment, the housing top 101 and bottom are rigidly connected to each other. As such, they do not slide relative to one another.

When the UK plug is inserted, the live pin of the UK plug contacts the live internal connector 108 of the adaptor, the neutral pin of the UK plug contacts the neutral internal connector 109 of the adaptor and the earth pin of the UK plug contacts the internal ground 110.

Figure 15:
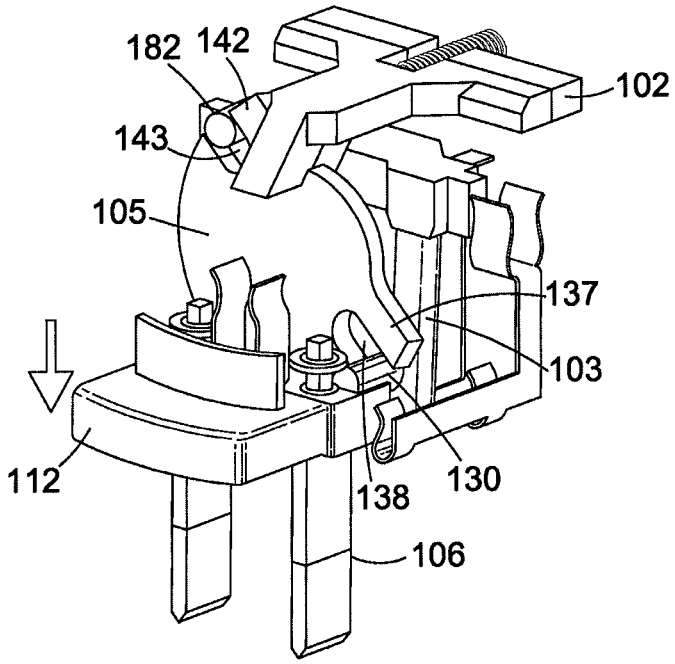
FIG. 15 is an assembled view of the internal mechanism of the travel adaptor of FIG. 14 with the housing of the adaptor removed for clarity with the internal parts of the travel adaptor being arranged in a first configuration—the US configuration.

FIG. 15 shows the relative arrangement of the internal components of the adaptor 100 when the adaptor is configured for US/Australian output 106. The US/Australian pins 107 are deployed when the operating lever or button 112 is in the "pushed down" position of FIG. 15 (see the arrow). The lever 112 is rigidly mounted onto the stems of the US/Australian plug assembly 106 so that when the lever 112 is actuated by a user the US/Australian plug assembly is moved accordingly back and forth, linearly along its pins' axes (or through the plane defined by those axes) as required.

Actuation of the lever and of the US/Australia plug 106 also actuates the internal guide plate 105 in that the guide plate 105 is caused to rotate around its pivot axle (not shown in the Figures). As a consequence, the right hand arm 137 (as viewed in the Figures) of the guide plate is caused to move when the US plug is moved.

Starting from the condition of FIG. 15, movement of the lever 112 upwards therefore causes the right hand arm t37 to lift since a pin 130 extending rearwardly relative to the lever 112 engages into a recess or slot 137 of that guide plate. This corresponds to an anticlockwise rotation of the guide plate in the illustrated view.

Likewise that rotation causes a second pin 182 (see FIGS. 14 and 15) that extends forwards relative to the base 103 of the European pins 104 to move downwards since it is captured in a corresponding slot or recess 143 on the other side of the guide plate by another arm 142.

The two pins 130, 182 are preferably cylindrical so as to rotate smoothly within the respective slot or recess 138, 143 of the guide plate.

Figure 16:
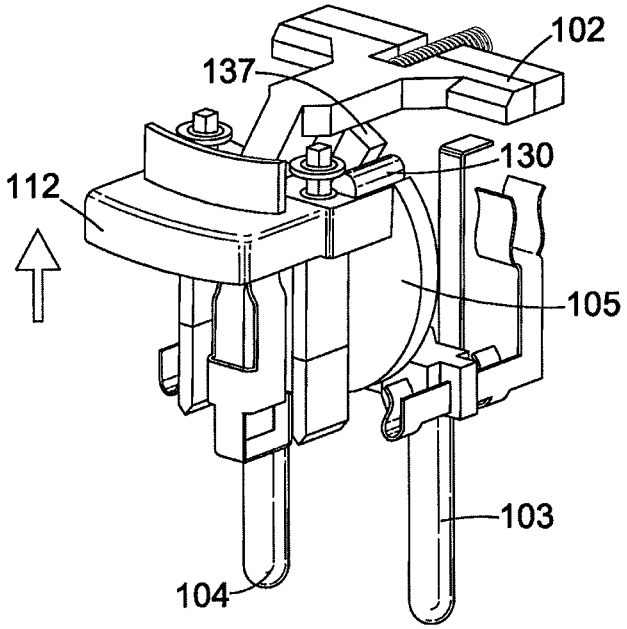
FIG. 16 is an assembled view of the internal mechanism of the travel adaptor of FIG. 14 with the housing of the adaptor removed for clarity with the internal parts of the travel adaptor being arranged in a second, alternative, configuration—the European Shuko configuration.

FIG. 16 shows the relative displacement of the internal components of the adaptor 100 when the adaptor has been switched to the configuration for European output. In this case the operating lever 112 is in an upwards position on the adaptor 100—see the arrow. The guide plate 105 has correspondingly been rotated anticlockwise compared to FIG. 15 so that its right hand arm 137 is up and its left hand arm 142 (not visible behind the lever 112) is down.

The pins of the European plug assembly 103 are therefore now deployed or exposed out of the output face of the adaptor 100, whereas the US pins are retracted or concealed. The switching of the pins occurs simultaneously.

In this embodiment, the switching means are provided by the guide plate which is positioned between the two plug assemblies 103, 106. It lies in a plane that is essentially parallel with the slide-planes of the two plug assemblies, with the two plug assemblies having the means to engage with the guide plate, as that plate rotates, due to the two pins in those plug assemblies extending out-of-plane of those plug assemblies. However, an alternative switching means may be provided. For example the guide plate may have the arms, and the plug assemblies may have the slots into which those arms extend.

Further, other switching arrangements may be possible involving, for example, a variety of switching means such as gear wheels or the like.

Figure 17:
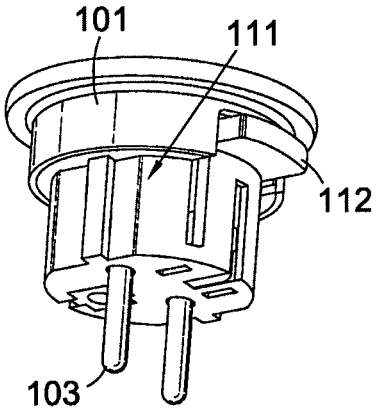
FIG. 17 is a perspective view of the travel adaptor of FIG. 16, still in the second configuration.
Figure 18:
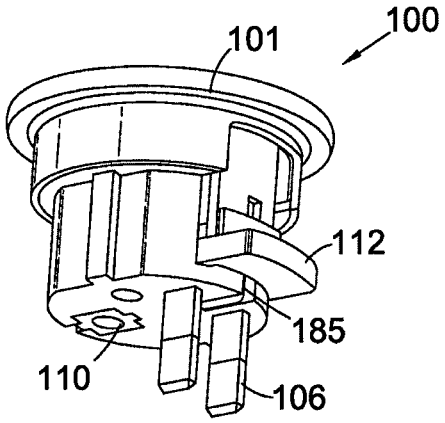
FIG. 18 is a perspective view of the travel adaptor of FIG. 15, still in the first configuration.

FIGS. 17 and 18 again show this third embodiment in the two alternative, switchable configurations. They also show where the earthing points of the internal earthing network 125 are on the outside of the adaptor. There is a first female grounding connection available on the output face of the adaptor 100—see socket 110. The other possible grounding point is directly attached to the earth pin of the UK mains plug. It is marked at point 185. This is similar to that which has been previously described.

Figure 19:
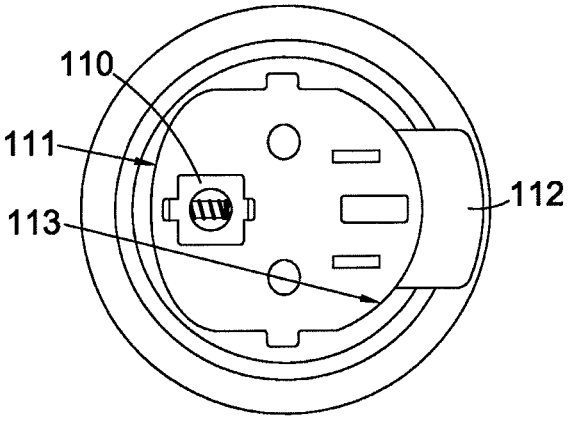
FIG. 19 is an underneath plan view of the travel adaptor of FIGS. 14 to 18, showing the ends of the US and European pins, and components of the adaptor's earth circuitry.

FIG. 19 then shows these earthing points again, but now in plan view. The view shows the output face of the adaptor 100 showing the European pins 103, the US pins 106, the female ground connection 110, and the base 111 with a modified Shuko profile 113. This is to allow the UK ground pin 114 to fit within the footprint of the bottom cover plate 111—as shown, the right hand Shuko profile 113 is slightly extended off from the usual circular trajectory to allow more room for the UK earth pin. However, it is still within the required standard.

Figure 20:
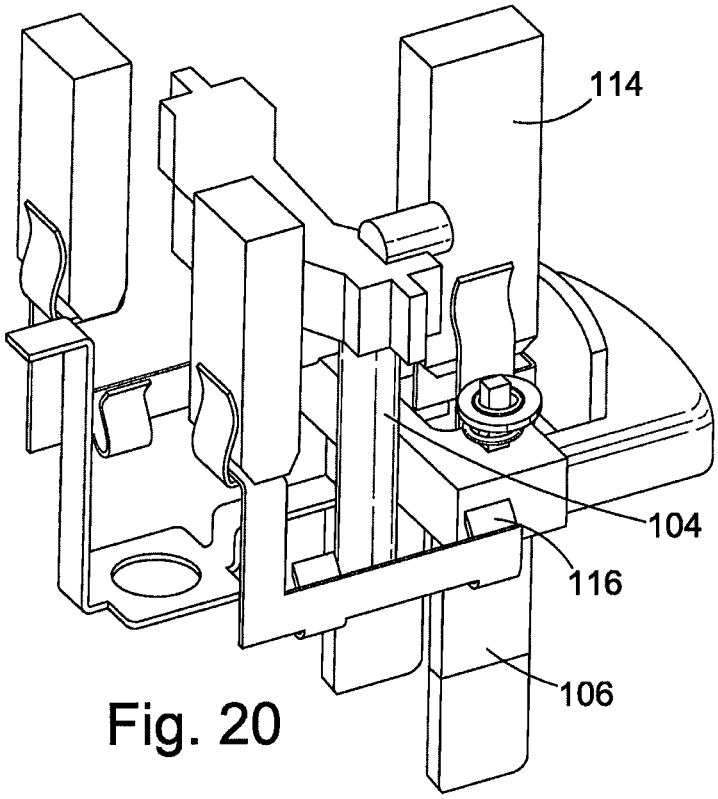
FIG. 20 is a perspective view of the network of internal conductors of the embodiment of FIGS. 14 to 19, and details of how they interact with both a UK plug's pins and the plug assemblies of the adaptor.
Figure 21:
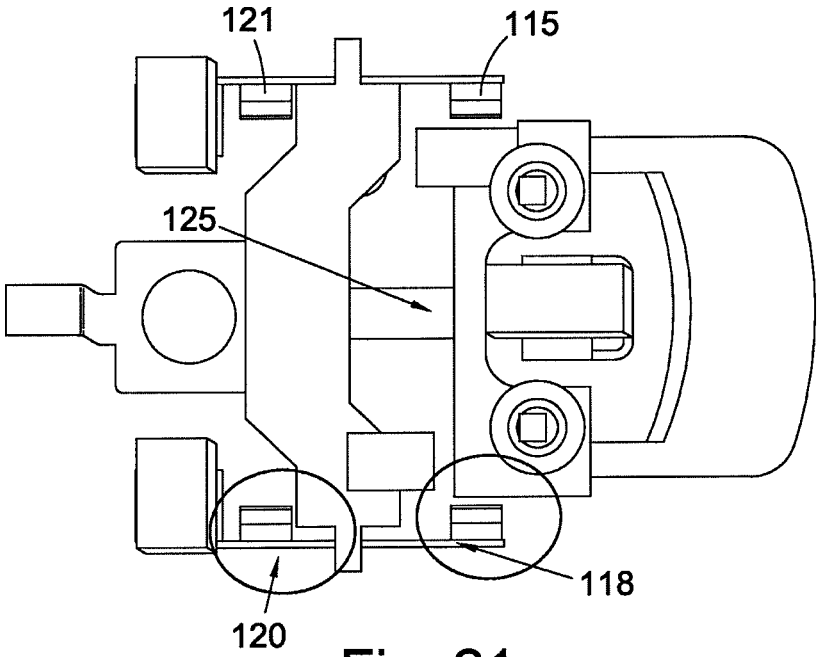
FIG. 21 is a plan view of the arrangement of FIG. 20.

Next, referring to FIG. 20 there is shown the relative location of the UK pins (when they are present in the adaptor) and the US and European pins, together with an illustration of the internal network of electrically conductive elements which ensure electrical continuity between input and output. The UK mains plug's three pins are each housed in the corresponding contacts, and the US plug assembly 106 is deployed, i.e. it is in its forward position. The European plug assembly 104 is retracted. The US plug assembly, in this configuration, can be energised by means of two small side connectors 115, 116, located respectively to either side of the US plug assembly for engaging contacts of the respective pins. The contacts (not shown), can be on the sides of the plug assembly, where the connectors engage when the plug assembly is so positioned. Both connectors 115, 116 can be seen in FIG. 21. They can be spring biased to engage the US plug assembly.

When the output is instead switched to the European plug, the US connectors 115, 116 become disengaged from electrical contact with the US plug assembly, whereby those pins are no longer "live". However, as the European pins 104 are instead deployed, they electrically connect to two alternative connectors 120, 121. Again the connectors on the European plug assembly are not shown, but they can be to the sides of the plug assembly. That new electrical continuity restores electrical continuity with the UK plug above.

The present invention therefore achieves a number of advantages—user friendliness, compactness of design, efficient manufacture and desirable external appearance amongst others.

The present invention has been described above purely by way of example. As it will be apparent to the skilled person, modifications in detail may be made to the invention within the scope of the claims appended hereto. Likewise features from one embodiment can readily be transferred to other embodiments, and various formats of standard pin arrangements can be accumulated, such as various inputs and various combinations of outputs, as mentioned above.

What is claimed is:

1. An adaptor for adapting a mains plug according to a first national standard to fit into a mains socket according to a second, different, national standard, the adaptor comprising:

a housing with a socket for receiving a mains plug according to the first national standard;

at least two plug assemblies according to different national standards, each having a deployable part in accordance with at least one pin component of the respective national standard, one of the at least two plug assemblies being according to the second national standard;

an externally operable selection mechanism for selectively deploying, or for making externally deployable, a non-deployed deployable part of one of the at least two plug assemblies, the non-deployed deployable part, upon its deployment, becoming insertable into a mains socket in accordance with the respective national standard therefor and thereby making the said one of the at least two plug assemblies usable, and the selection mechanism also, simultaneously, at least partially concealing a deployed deployable part of a different one of the at least two plug assemblies to render that previously usable, different one of the at least two plug assemblies, now unusable; and a network of internal conductors for providing at least two respectively insulated paths of electrical continuity between the socket of the housing and a usable one of the at least two plug assemblies wherein at least one of the plug assemblies is in a fixed arrangement with respect to the housing during the operation of the selection mechanism, the fixed position of such a plug assembly being the position of that plug assembly, relative to the housing, when that assembly is in an operational, usable, condition.

2. An adaptor according to claim 1, wherein the externally-operable selection mechanism comprises a displaceable cover that is displaceably arranged with respect to both the housing and that fixed plug assembly, and wherein, when the selection mechanism is operated, the displaceable cover is spatially displaced relative to the housing so as to provide a concealing action over the fixed plug assembly.

3. An adaptor according to claim 2, wherein the displaceable cover is an inner core of the housing.

4. An adaptor according to claim 2 wherein the displaceable cover is slidingly displaceable with respect to the housing.

5. An adaptor according to claim 4 wherein the displaceable cover is telescopically displaceable with respect to the housing.

6. An adaptor according to claim 2 wherein at least one plug assembly is mounted on or within the displaceable cover such that it has a selectively moveable arrangement with respect thereto, and wherein the displaceable cover has an output face and wherein said plug assembly has at least two pin contacts, the pin contacts of that plug assembly being extractable so as to extend from the output face of the displaceable cover.

7. An adaptor according to claim 6, wherein the output face is equipped with a cover plate, wherein the cover plate is moveable with respect to the output face to selectively reveal or hide the contact pins.

8. An adaptor according to claim 2, wherein the displaceable cover and the housing are coaxial.

9. An adaptor according to claim 2, wherein the displaceable cover is retainable into a position by a click fit or snap fit provided in cooperation with the housing.

10. An adaptor according to claim 2, wherein the externally-operable selection mechanism comprises a sliding lever protruding outwardly of the displaceable cover.

11. An adaptor according to claim 2, wherein the displaceable cover provides an earth connector.

12. An adaptor according to claim 2, wherein the displaceable cover provides a mechanical male plug for connection into a mechanical female socket.

13. An adaptor according to claim 12, wherein the displaceable cover has an outer profile compatible with a Schuko socket configuration.

14. An adaptor according to claim 2, the adaptor further comprising a spring member for action between the moveable plug and the displaceable cover.

15. An adaptor according to claim 2, the adaptor further comprising a lock for locking the moveable plug in the deployed configuration.

16. An adaptor according to claim 2, wherein the externally-operable selection mechanism comprises a sliding lever protruding outwardly of the displaceable cover, the adaptor further comprising a spring member for action between the moveable plug and the displaceable cover, and the sliding lever is arranged for being pushed down to release the moveable plug assembly and/or to release the lock.

17. A telescopic travel adaptor for adapting a mains plug according to a first national standard to fit into a mains socket according to a second, different, national standard, the adaptor comprising:

a first base;

a second base that is telescopically extendable relative to the first base; and at least two plug assemblies according to different national standards, one of the at least two plug assemblies being according to the second national standard;

wherein the mains plug according to the first national standard can be plugged into the first base; and one of the plug assemblies is configured for selectively extending out of the second base into a usable configuration for plugging into the mains socket according to the second, different, national standard when the second base has been telescopically extended; and another of the plug assemblies is configured in the adaptor for being at least partially concealed, and therefore caused to be unusable with respect to its respective national mains socket standard, by that telescopic extension, wherein the said another of the plug assemblies is in a fixed arrangement with respect to a housing of the adapter during the telescopic extension of the second base, the fixed position of at said another of the plug assemblies being the position of that plug assembly, relative to the housing, when that assembly is in an operational, usable, condition.

18. An adaptor according to claim 17, further comprising a selection mechanism, wherein the selection mechanism comprises a mechanical switch for switching the adaptor between alternative output configurations.

19. An adaptor according to claim 18, wherein operation of the selection mechanism is performed via an actuation lever or button provided externally of the housing.

20. A mains cable for plugging an electrical appliance selectively to at least two different sockets according to two different standards, the mains cable having a mains plug on its end, the mains plug featuring an adaptor mechanism with at least two plug assemblies therein, the at least two plug assemblies each meeting a different national standard, and each having a deployable part in accordance with at least one pin component of the respective national standard, wherein the adaptor mechanism comprises:

an externally operable selection mechanism for selectively deploying, or for making externally deployable, a non-deployed deployable part of one of the at least two plug assemblies, the non-deployed deployable part, upon its deployment, becoming insertable into a mains socket in accordance with the respective national standard therefor and thereby making the said one of the at least two plug assemblies usable, and the selection mechanism also, simultaneously, at least partially concealing a deployed deployable part of a different one of the at least two plug assemblies to render that previously usable, different one of the at least two plug assemblies, now unusable; and a network of internal conductors for providing at least two respectively insulated paths of electrical continuity between the socket of the housing and a usable one of the at least two plug assemblies;

wherein at least one of the plug assemblies is in a fixed arrangement with respect to the housing during the operation of the selection mechanism, the fixed position of such a plug assembly being the position of that plug assembly, relative to the housing, when that assembly is in an operational, usable, condition.

* * * * *